US005603119A

United States Patent [19]

Rinehart

[11] Patent Number: 5,603,119

[45] Date of Patent: Feb. 18, 1997

[54] GLOVE OR INSERT AND METHOD FOR PRODUCING THE SAME

[75] Inventor: Dixie Rinehart, Montrose, Colo.

[73] Assignee: Arthur D. Little Enterprises, Inc., Cambridge, Mass.

[21] Appl. No.: 267,688

[22] Filed: Jun. 28, 1994

[51] Int. Cl.[6] ..... A41D 19/02

[52] U.S. Cl. ..... 2/169; 2/163; 2/161.1

[58] Field of Search ..... 2/159, 160, 161.1, 2/161.2, 161.5, 161.6, 163, 164, 167, 169

[56] References Cited

U.S. PATENT DOCUMENTS

| | | | |
|---|---|---|---|
| 550,592 | 12/1895 | Chant | 2/169 |
| 1,540,718 | 6/1925 | Sturm | 2/164 |
| 1,909,863 | 5/1933 | Johanson | 2/169 |
| 2,248,200 | 7/1941 | Rowles | 2/169 |
| 2,256,427 | 9/1941 | Gitt | 2/169 |
| 2,298,959 | 10/1942 | McClurken | 2/169 |
| 3,114,915 | 12/1963 | Gross | 2/169 |
| 4,411,026 | 10/1983 | Secter | 2/169 |
| 4,430,759 | 2/1984 | Jackrel | 2/169 |
| 4,583,248 | 4/1986 | Edwards et al. | 2/169 |
| 4,594,736 | 6/1986 | Connelly | 2/164 |
| 4,654,896 | 4/1987 | Rinehart | 2/164 |
| 4,831,667 | 5/1989 | Town | 2/164 |
| 5,167,038 | 12/1992 | Rinehart | 2/164 |

*Primary Examiner*—C. D. Crowder
*Assistant Examiner*—Larry D. Worrell, Jr.
*Attorney, Agent, or Firm*—Jennifer Taggart; Bernard Lacomis

[57] ABSTRACT

A hand covering is provided which is formed of a finger portion and a lower hand portion. The lower hand portion is formed from a one piece back and palm part, or in the alternative a two piece back and palm part; each lower hand portion includes integral thumb portions. After sealing the lower hand portion in the flat, the lower hand portion is rotated prior to sealing it to the finger portion. The rotation positions the thumb portion in working relationship with, or in opposition to, the finger portion and provides that no more than two seams intersect at a joint.

2 Claims, 8 Drawing Sheets

GLOVE OR INSERT AND METHOD FOR PRODUCING THE SAME

BACKGROUND OF THE INVENTION

1. Field of the Invention

This invention relates to a hand covering and the construction of a hand covering formed of a finger portion and a lower hand portion and more particularly to a hand coveting having a lower hand portion which is sealed in the flat and rotated prior to sealing it to the finger portion.

2. Description of the Related Art

Various forms of glove or hand covering construction and liners for enclosing the lower hand portion of a hand are available. It is often desirable to protect a glove wearer's hand from external moisture or chemicals by providing a liquid-proof insert member or a liquid-proof hand covering. However, the inherent nature of seaming material in any fashion can create leakage. As the number of seams in the construction of a hand coveting increases, the chance of leakage also increases. This problem is further exacerbated at locations within hand coveting construction where a number of seams meet each other at a joint, due to the weak nature of joints.

Manufacturing procedures for construction and seaming of hand covering inserts are similar to those of hand coverings. Very thin materials are generally used in the fabrication of inserts to keep the bulk and stiffness of inserts and hand coverings to a minimum. Rubber and plastic dipped liquid-proof liners are not generally acceptable, as they are too stiff and bulky, and as such, adversely affect the dexterity and mobility of hand covering assemblies.

Materials suitable for use as liquid-proof inserts include relatively thin, pliable air or water permeable or impermeable films, such as breathable microporous Polytetrafluoroethylene (PTFE). An example of such a material is sold, under the trademark Gore-Tex® film, by W. L. Gore and Associates, Inc. Films may be used alone or as a laminated construction bonded to other materials, such as a thin stretch nylon fabric. In assembling these materials into an insert, the insert seams are heat sealed shut or are sealed shut with liquid-proof tapes. Stitching is generally avoided as it produces holes in the material which requires further sealing.

Liquid-proof/breathable hand covering inserts are typically in two layer construction using an outer shell only, or in three layer constructions which include an additional insulation or liner layer. In the latter construction, the liner is usually disposed between the outer shell and the inner insulation liner. In both embodiments it is necessary that the insert be sized small enough to avoid adversely affecting the dexterity, mobility and tactility of the total hand covering system. Bending of the wearer's hand within the hand covering requires that the insert, as well as other parts of the hand covering, have sufficient length to accommodate the bending of the fingers and the thumb at the knuckle joints, without binding the layers during such movement of the hand. In addition, the insert should not be too large so as to contribute excessive bulk to the hand covering system, since bulk causes discomfort and adversely affects dexterity, mobility and tactility.

Presently, liquid-proof inserts are formed from pattern pieces which are superimposed on one another and laid flat during the joining of the pieces by a heat sealing process, resulting in a flat, two-dimensional insert. Flat joining is done to avoid complicated manufacturing techniques during the heat sealing step. However, these prior art techniques for joining in the flat require the pattern pieces to be generally made oversized in all respects relative to the dimensions of the wearer's hand to accommodate the more generous amounts of material needed in some areas of the hand. In order to provide the required material to cover the width and circumference of the four fingers of the hand, the geometry of the hand portion below the junction of each finger, the lower hand portion, must be patterned to an oversized dimension so that the resulting flat insert may adequately fit the fingers without binding. The oversized dimension is generally equal to the sum of the combined widths of the finger pans of the insert, and therefore provides more material than is required for the width of the hand immediately below the junction of the finger pans (the lower hand portion). This results in increased bulk, additional material usage and a non-conforming, uncomfortable fit for the hand. Applicant has addressed this problem with respect to the finger portion of the hand covering in earlier U.S. Pat. Nos. 4,654,896 and 5,167,038.

Sealing or seaming the finger portion of the hand covering to the lower hand portion creates its own set of leakage and fit problems which shall be addressed herein. Decreasing the number of seams needed is advantageous in that fewer sealing areas decreases potential leakage. The ability to seal in a two-dimensional plane, or in the flat, is advantageous in that it avoids complicated and costly manufacturing techniques. The ability to position the thumb of the hand covering in opposition to the finger portion of the hand covering is also advantageous in that it creates a more comfortable fit for the wearer and reduces puckering. The prior art does not address how to manufacture and seal the lower hand portion of the hand covering in a flat two-dimensional plane with the thumb positioned in opposition to the fingers, without additional seaming.

A typical construction of the lower hand portion and separate thumb portion assembly which is formed of more than two pieces is shown in FIG. 5 of U.S. Pat. No. 5,167,038. In that construction, two flat pieces comprising the back portion and the palm portion are joined together to form the lower hand portion and two additional separate pieces are used to form the thumb portion. The lower hand portion and the thumb portion are joined by forming a hole in the palm portion and sealing the thumb portion to the periphery of the hole. The hole, for attaching the thumb portion, is spaced slightly inward from the side of the lower hand portion so that once attached, the thumb portion is positioned in opposition to the finger portion of the hand covering. Inward positioning of the thumb portion creates a more comfortable fit for the hand covering wearer. This configuration avoids the excessive puckering normally found when the thumb portion is located along the side of a hand covering, and a hand covering wearer tries to move the thumb portion inward to a more natural position opposing the finger portion. While this construction addresses and solves the excess material puckering problem and creates a more comfortable fit, it is undesirable because this process is very labor intensive and difficult when hand coverings are to be mass produced. This configuration also requires numerous seams, which increases the probability of leakage.

Past hand covering designs have shown the fabrication of the lower hand portion of the hand covering in a flat two dimensional configuration, after which the lower hand portion is then sealed to the finger portion of the hand covering. Methods of this type are disclosed in U.S. Pat. Nos. 4,654,896 and 5,167,038. While these patents are desirable because portions of the hand covering can be seamed or sealed in the flat, these past designs are undesirable because they require numerous seams, and in many instances, the intersection of more than two seams at a joint. Accordingly, it would be desirable to provide a lower hand portion of a hand covering which has an integrated thumb portion and can be constructed from only one or two flat pieces thus avoiding the need to attach a separate thumb portion while also avoiding the intersection of more than two seams at a joint. In addition, it would be desirable to provide a lower hand portion which can be joined to a finger portion which utilizes a minimum amount of material while providing proper fit and comfort.

SUMMARY OF THE INVENTION

In accordance with this invention, a lower hand portion of a hand covering and method of manufacturing the same is provided. The lower hand portion of this invention includes a palm part and a back part including integral thumb portions. The lower hand portion is sealed together and is then rotated prior to sealing it to a finger portion of the hand covering. This hand covering and method are advantageous in that three seams do not intersect at any point or joint and the thumb portion is positioned in working position with the index finger, or in opposition to the finger portion of the hand covering.

The palm and back portions of the lower hand portion of the hand covering may be formed from either one piece of material folded over onto itself and then sealed at the open side, or alternatively, from two separate flat pieces which are subsequently sealed together about both sides.

DESCRIPTION OF THE PREFERRED EMBODIMENT

Figure 1:
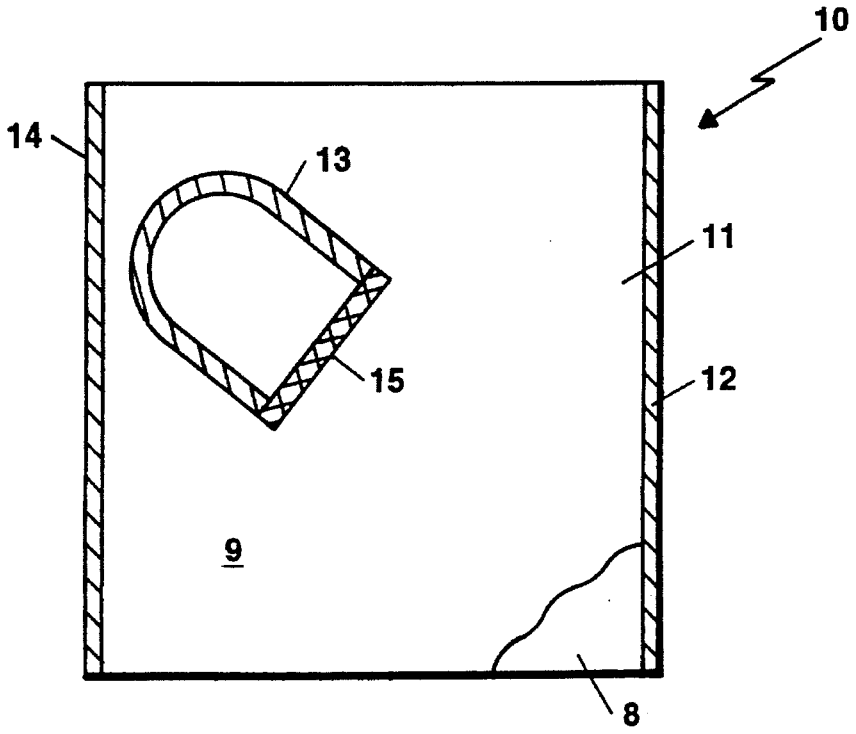
FIGURE 1 PRIOR ART
FIG. 1 is a plan view of a palm part of the lower hand portion of a prior art hand covering partially sectioned to show a back part.

A one piece lower hand portion of a hand covering is formed from one piece of material. The lower hand portion is created by folding a piece of hand covering material over onto itself to form palm and back portions. The palm and back portions of the material have integrated thumb portions, which are mirror images of each other and, upon folding, are mated. The orientation of the fold is such that if the unfolded one piece palm and back part with integral thumb portions were laying flat with the thumb extensions located on the far left and far right sides of the piece, the folding would occur along the vertical centerline of the piece. The lower hand portion is sealed in the flat along the edge of the folded lower hand portion which contains the superimposed thumb portion and is opposite to the fold line. This sealing creates a flat tube-like structure which has openings on two opposite sides, is sealed on one side and is folded on the side opposite thereto.

Alternatively, a two piece lower hand portion of the hand covering is formed by sealing together two flat mating pieces, the palm part and the back part. The palm part and the back part each have an integral thumb portion. The palm part and the back part are of similar size and dimension, the only difference being that the integral thumb extensions are positioned such that upon laying the palm part on top of the back part, or visa-versa, the two thumb extensions are mated. The two mating pieces are then sealed in the flat on two opposite sides. The sealing of the two sides or edges is done such that the sealed lower hand portion is in the form of a flat tube-like structure which has openings on two opposite sides, and is sealed on the other two opposite sides, one of which contains the integral thumb extension.

The lower hand portion of the hand covering may also be formed by either of the above methods with a slight variation in that the thumb extensions do not need to be integral with the palm and back portions of the hand covering, but rather can be a separate pieces attached to or sealed to an edge of the palm and back parts of the lower hand portion of the hand covering at any stage of the hand covering fabrication described above.

Regardless of which of the above embodiments is used to fabricate the lower hand portion of the hand covering, the remaining steps in the hand covering fabrication are the same.

The flat tube-like lower hand portion of the hand covering is then rotated along its longitudinal axis such that the thumb extension seam line or edge is no longer located at the side of the lower hand portion. The thumb extension seam line or edge is located inward from and a certain distance away from the side of the hand covering. In other words, after rotation, the thumb extension seam line is located between, and spaced apart from, the outermost peripheries or sides of the tube-like lower hand portion. The thumb extension seam line or edge is rotated to be closer to the two-dimensional centerline of the lower hand portion as the hand covering lays in the flat. This rotation transforms an otherwise flat, two-dimensional assembly into a three- dimensional assembly where the thumb extension is raised out of its flat state and takes on a three-dimensional configuration.

The rotated lower hand portion is then attached and/or sealed to the finger portion of the hand covering assembly by providing a finger-joining seam. The rotation of the lower hand portion of the hand covering is performed so that the thumb extension of the hand covering is located in natural opposition to the finger portion of the assembly. The rotation allows the thumb portion to be positioned in a working position with the index finger of the finger portion. Positioning the thumb extension in opposition to the finger portion is also desirable because it causes less puckering upon flexing the hand coveting and is more comfortable for the hand covering wearer.

Rotation of the lower hand portion also better positions the lower hand portion seam(s) for subsequent joining to the finger portion. After rotation, the side seam(s) of the lower hand portion will not coincide or intersect the side seams of the finger portion upon joining, as in prior art hand coverings. After rotation, the seams that originally laid at the sides of the lower hand portion, which upon rotation lay inward from the sides, and the side seams of the finger portion of the hand covering are positioned askew. The result of positioning the side seam(s) askew is that no seam junction or joint will have more than two seams intersecting at any given point. This arrangement provides better leakage control and strength reliability than found in previously disclosed methods where more than two seams intersect each other at a junction.

A hand covering or an insert to a hand covering may be formed from the above described configuration. A hand coveting may be formed as a single layer according to this invention, or it may be formed by inserting the hand covering insert of this invention into an outer glove shell, either alone or in conjunction with a lining or insulation layer. The outer glove shell, the hand covering insert and the insulation layer may all be fabricated according to the present invention. The hand covering or insert of the present invention may be manufactured from hand covering material that is liquid-proof, laminated, chemical proof or from hand covering material that has specific permeable or impermeable characteristics. The hand covering of this invention can be formed from one, two, three or more layers.

Referring to FIG. 1, there is shown a plan view of a lower hand portion 10 of a hand covering constructed according to the prior art. It is constructed by sealing the back 8 and palm 9 parts of hand covering material 11 together along edges 12 and 14. The thumb extension 13 is formed by separately sealing a tubular thumb portion to the lower hand portion 10 around a substantially circular hole in the lower hand portion 10 along edge 15 as shown. The additional sealing of a separate thumb extension piece can also be seen in U.S. Pat. No. 4, 831,667. The presence of a separate thumb extension piece 13 is necessary in prior art gloves so that the thumb extension 13 can be located in a comfortable position for the wearer on the finished hand covering, i.e. in opposition to the finger portion of the hand covering. The manufacturing of a hand covering of this type requires additional thumb extensions, holes, sealing steps and seams 15 at locations which can potentially cause leakage and seam fatigue. It is advantageous to be able to provide comfortable positioning of the thumb extension 13 without requiring additional sealing steps, while also being able to secure the hand covering pieces together in a flat condition as this makes the assembly of the hand covering or liner less complicated.

Figure 2:
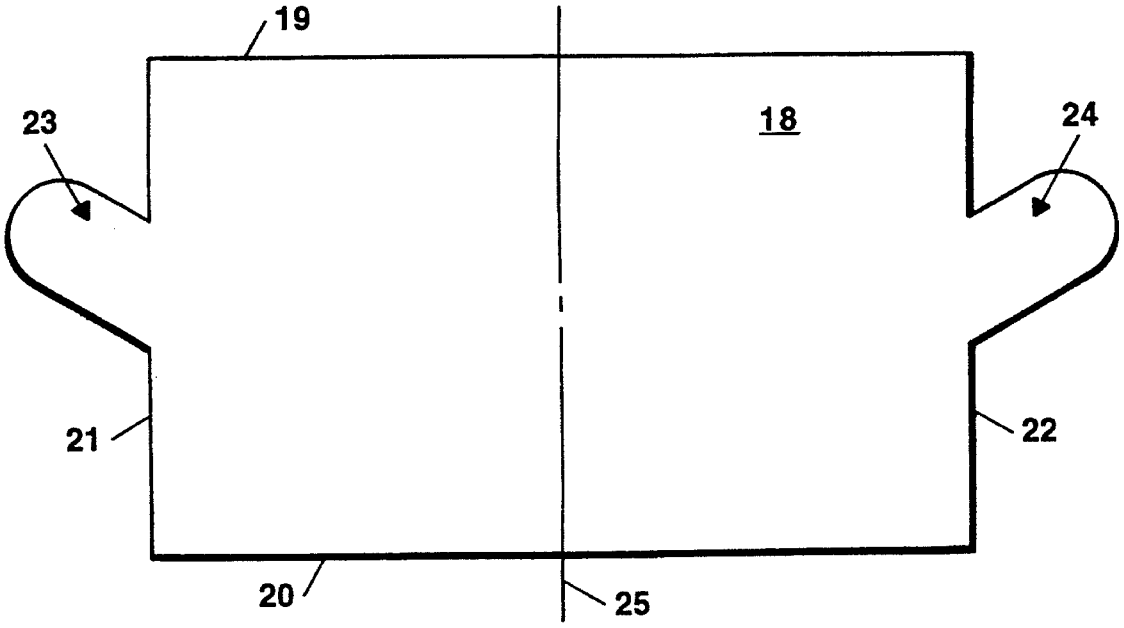
FIG. 2 is a plan view of a pattern piece forming the lower hand portion of a hand covering according to the present invention prior to folding and sealing the one piece palm and back parts.

Referring now to FIG. 2, there is shown a plan view of a preferred embodiment of the hand covering material of the lower hand portion 18 of a hand covering arranged according to the invention. The lower hand portion 18 comprises a single piece of material cut in a pattern including a first pair of substantially parallel edges 19, 20 and a second pair of substantially opposing edges 21, 22 including thumb extension portions 23, 24 symmetrically located about the lower hand portion centerline 25. Thumb extension portions 23, 24 are shaped and positioned along edges 21,22 such that they are mirror images of each other.

Figure 3:
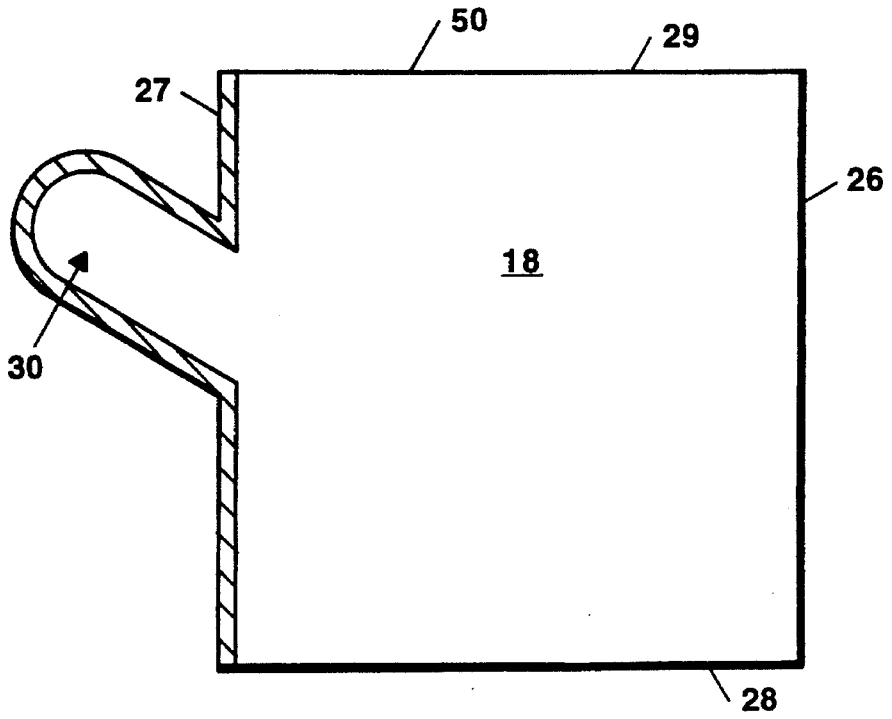
FIG. 3 is a plan view of the lower hand portion after the one piece palm and back parts shown in FIG. 2 has been folded and sealed.

Referring now to FIG. 3, there is shown a plan view of the lower hand portion 18 of the hand covering of FIG. 2 folded (along centerline 25 of FIG. 2) to create fold line 26. Edges 21, 22 and thumb extension portions 23, 24 of FIG. 2 are laid or superimposed upon each other to create integral thumb extension 30. The superimposed edges 21, 22 and thumb extension portions 23 and 24 are then sealed to form a tube-like structure having a seam or sealed edge 27. The lower hand portion 18 has an opening at one end 28 for the wearer to later insert his hand, and an opening at an opposite end 29 along which there is a coextensive edge 50, for later joining finger portions (not shown) thereto via a finger joining seam.

Figure 4:
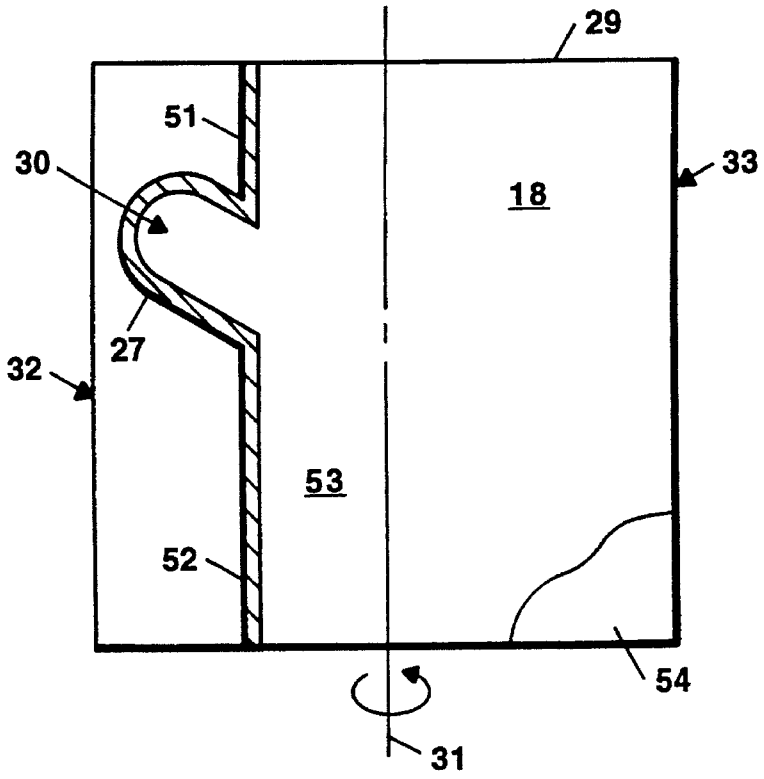
FIG. 4 is a plan view of the palm part of the lower hand portion of a hand covering shown in FIG. 3 where the lower hand portion has been rotated for proper positioning of the thumb extension and partially sectioned to show the back part.

Referring to FIG. 4, there is shown a plan view of the sealed lower hand portion 18 shown in FIG. 3, rotated about its longitudinal axis 31 such that when the sealed lower hand portion 18 is laid in the flat, the sealed edge 27 containing integral thumb extension 30 is no longer at the side of the sealed lower hand portion 18, but rather is positioned inward and a selected distance away from side 32. After rotation of the lower hand portion 18, sides 32, 33 which are radially spaced from the longitudinal axis 31 of the lower hand portion, are seamless. The lower hand portion has an integral palm part 53 and back pan 54. Seam 27 is located between, and spaced apart from, sides 32, 33. Seam 27 does not intersect sides 32, 33.

Figure 5:
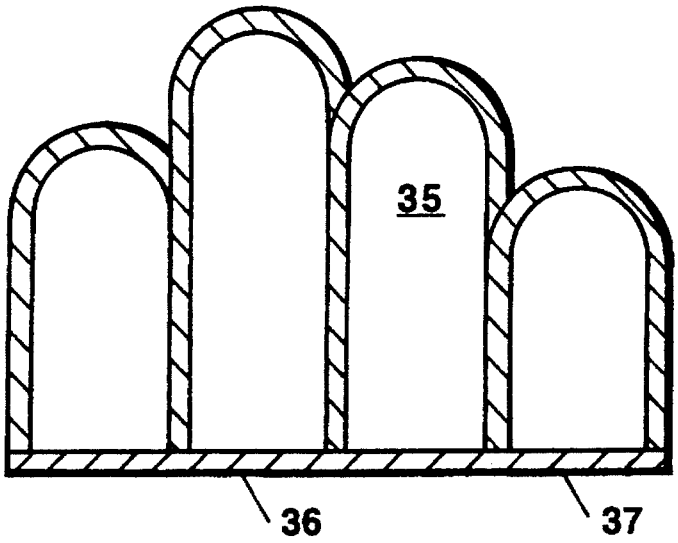
FIG. 5 is a plan view of a finger portion of a hand covering.

Referring to FIG. 5, there is shown a plan view of finger portion 35 of a hand covering in accordance with Applicant's prior U.S. Pat. No. 5,167,038, although any number of types of finger portions could be used in conjunction with this invention. Finger portion 35 is provided with an opening 36 such that a hand coveting wearer's fingers may be inserted therethrough. Along the opening runs a base line peripheral edge 37 for sealing the finger portion 35 to the lower hand portion 18.

Figure 6:
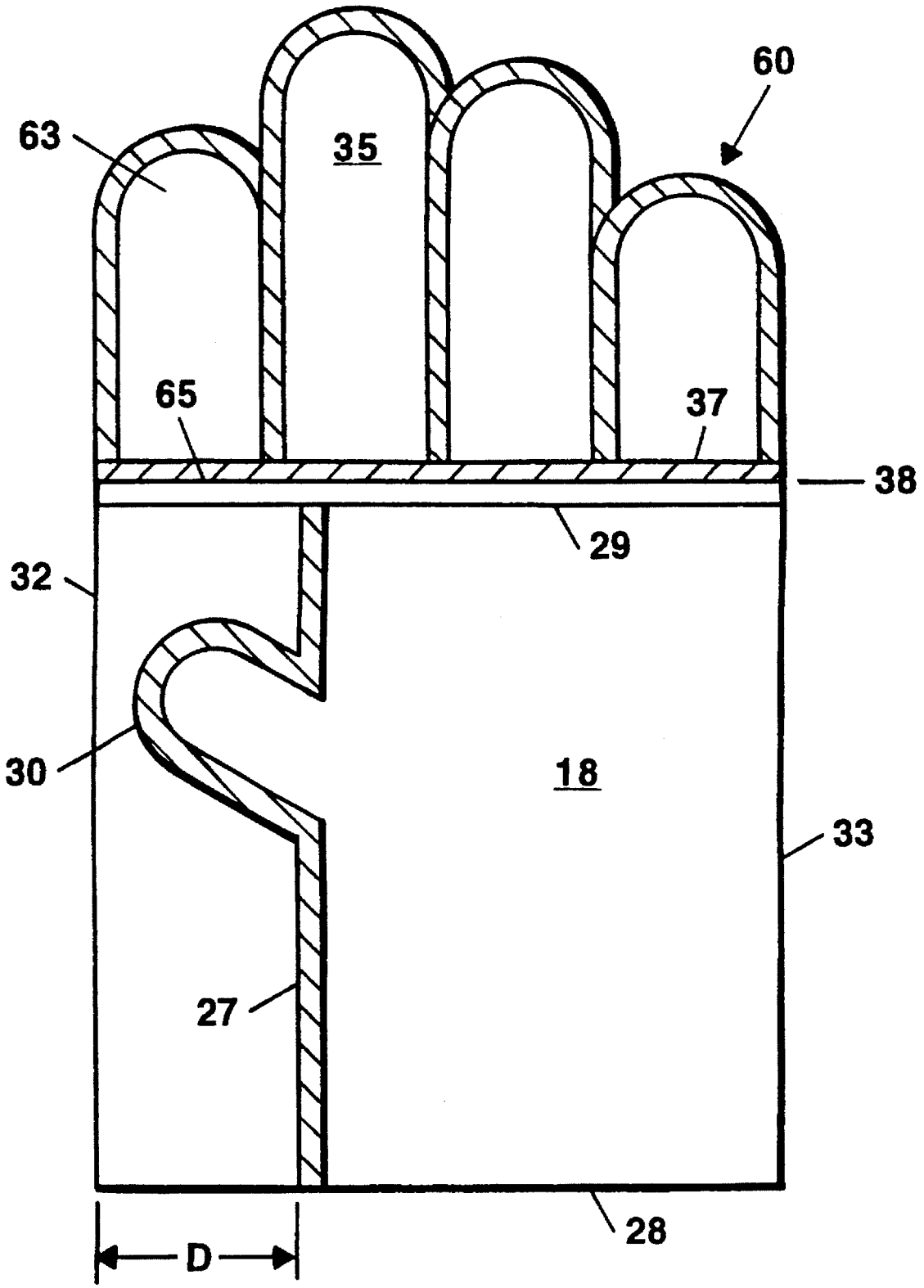
FIG. 6 is a plan view of a hand covering showing the finger portion of FIG. 5 and the palm portion of the lower hand portion of FIG. 4 sealed together.

Referring to FIG. 6, there is shown a plan view of the hand covering assembly 60 comprising the finger portion 35 and the lower hand portion 18, showing seam 27 after the lower hand portion 18 has been rotated. The sealed lower hand portion 18 is rotated so that no more that two seams will intersect at a joint upon subsequent joining of the lower hand portion 18 to the finger portion 35. The result of having only two seams intersect at a joint is far more advantageous than previously disclosed methods which incorporate the intersection of three seams at a joint. A sealed joint comprising a two seam intersection is more reliable than a sealed joint comprising a three seam intersection. Joints comprised of three seams are more difficult to seal, require more time and have a greater probability of failure do to leakage and seam fatigue. Sealed joints comprised of only two seams possess greater strength reliability and sealing characteristics.

Rotation of the lower hand portion 18 so that seam 27 is spaced apart from sides 32, 33 also creates a more comfortable fit for the wearer. This is because thumb extension 30 is positioned in a working relationship with the index finger 63 of the finger portion 35 of the hand covering 60. The amount of rotation needed to create a comfortable fit for the hand covering wearer is dependent of the size of the hand covering 60, the size of the wearer's hand, the type and thickness of the hand covering material, as well as other factors. Generally, the rotation will provide a dimension, D, in the range of about ¼ (0.25) to 2 inches, and more preferably in the range from about ½ (0.50) to 1 inch, as measured horizontally from side 32 to the rotated thumb extension seal edge 27.

The base line periphery 37 of the finger portion 35 is sealed to the coextensive edge 29 of the lower hand portion 18 by seam 38. Joint 65 is comprised from only the intersection of seam 27 and seam 38. Joint 65 is the only joint in the glove assembly 60 comprising a seam 27 originating from the lower hand portion 18.

An elastic closure band or other type of cuff (not shown) may be seamed or sealed to the bottom opening 28 of the hand covering assembly 60, if desired. If the hand covering assembly 60 has been fabricated with the fight sides together, then the hand covering assembly 60 may be turned inside out. Additionally, if a liquid-proof hand covering is desired, the hand covering assembly 60 may be dipped or sprayed with the appropriate material or solution.

Figure 7:
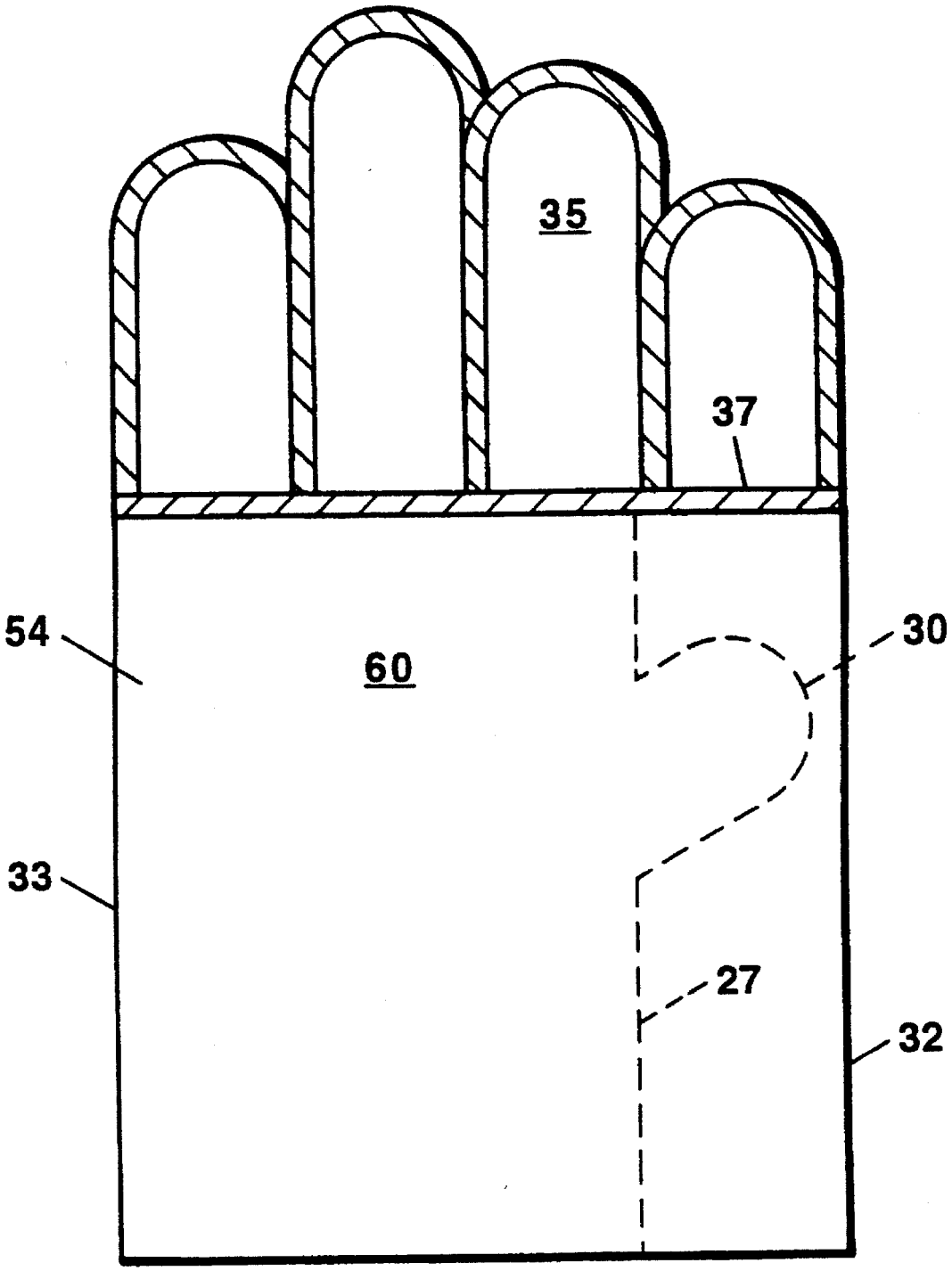
FIG. 7 is a plan view of the hand covering of FIG. 6 showing the back of the finger portion of FIG. 5 and the back part of the lower hand portion of FIG. 4 sealed together.

Referring to FIG. 7, there is shown the a plan view of the back of hand covering 60 according to the preferred embodiment. The back pan 54 of lower hand portion 35 does not have any seams. Nor are there any seams on sides 32, 33 of the back pan 54.

Figure 8:
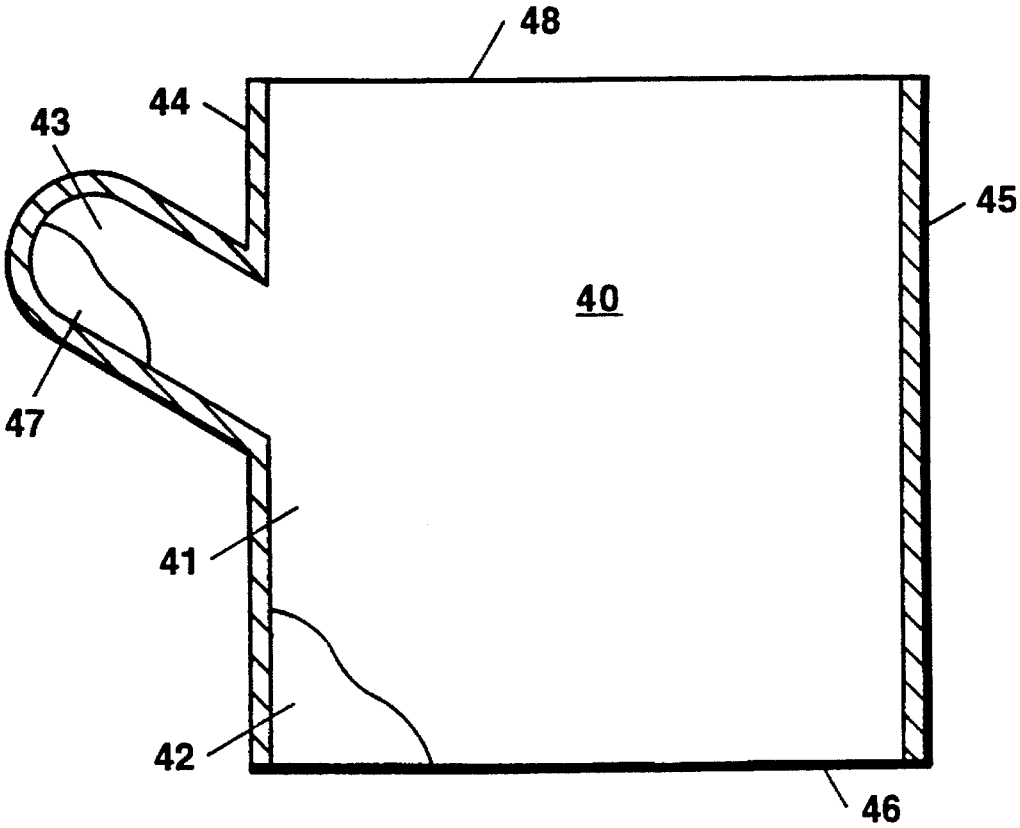
FIG. 8 is a plan view of another embodiment of the lower hand portion of a hand covering partially sectioned to show palm and back portions sealed together.

Referring to FIG. 8, there is shown a lower hand portion 40 comprising superimposed palm and back pieces 41, 42 each having integral thumb extensions 43, 47 which are mirror images of each other. The palm and back pieces 4 1, 42 are laid flat upon each other and are sealed in the flat along two opposite edges 44, 45 including the edge along which runs thumb extension 43, 47. When sealed, the thumb extensions 43, 47 form a tube-like structure for receiving a wearer's thumb. The sealing at the two opposite edges 44, 45 creates a tube-like structure with an opening at one end 46 for the wearer to later insert his hand, and another opening opposite thereto, along which there is a coextensive edge 48 for later joining to the base line periphery 37 of the finger portion of the hand covering shown in FIG. 5. The remaining steps in the hand covering fabrication including rotation of the lower hand portion 40 are the same as in the above described embodiment of FIG. 4.

Figure 9:
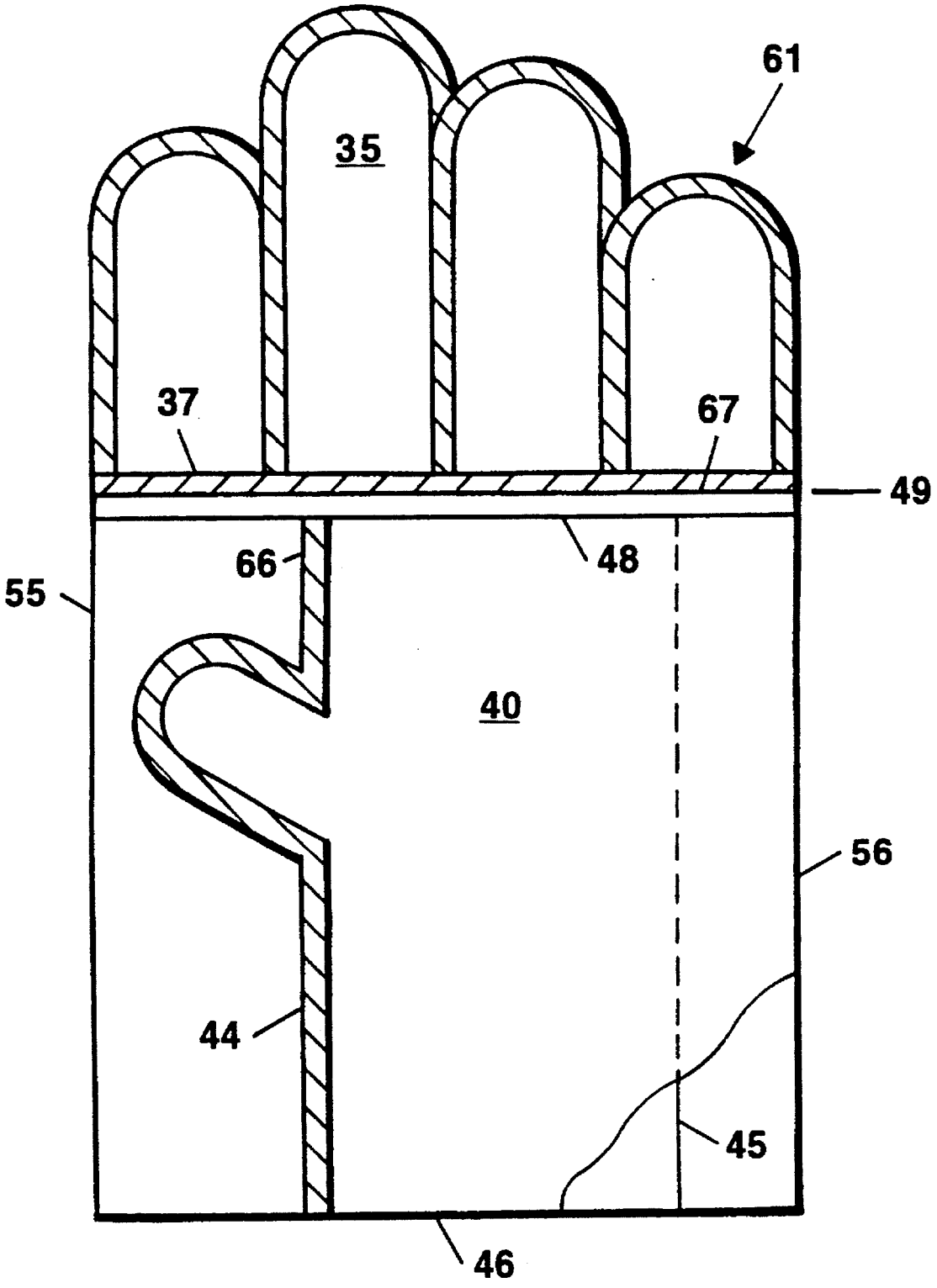
FIG. 9 is a plan view of a hand covering showing the finger portion of FIG. 5 and the lower hand portion of FIG. 8 sealed together.

Referring to FIG. 9, there is shown the hand covering assembly 61 comprising the finger portion 35 and the lower hand portion 40, after the lower hand portion 40 has been rotated and sealed to finger portion 35. Sealed edges 44, 45 are located between sides 55, 56. Sealed edges 44, 45 do not intersect sides 55, 56. The base line periphery 37 of the finger portion 35 is sealed to the coextensive edge 48 of the lower hand portion 40 by finger joining seam 49. Joints 66, 67 are each comprised from only the intersection of two seams. Joint 66 is comprised from only the intersection of seam 49 and 44. Joint 67 is comprised from only the intersection of seam 49 and 45. Joints 66, 67 are the only joints in the glove assembly 61 comprised of seams originating from the lower hand portion 40. An elastic closure band or other type of cuff (not shown) may be seamed or sealed to the bottom opening 46 of the hand covering assembly 61, if desired.

Figure 10:
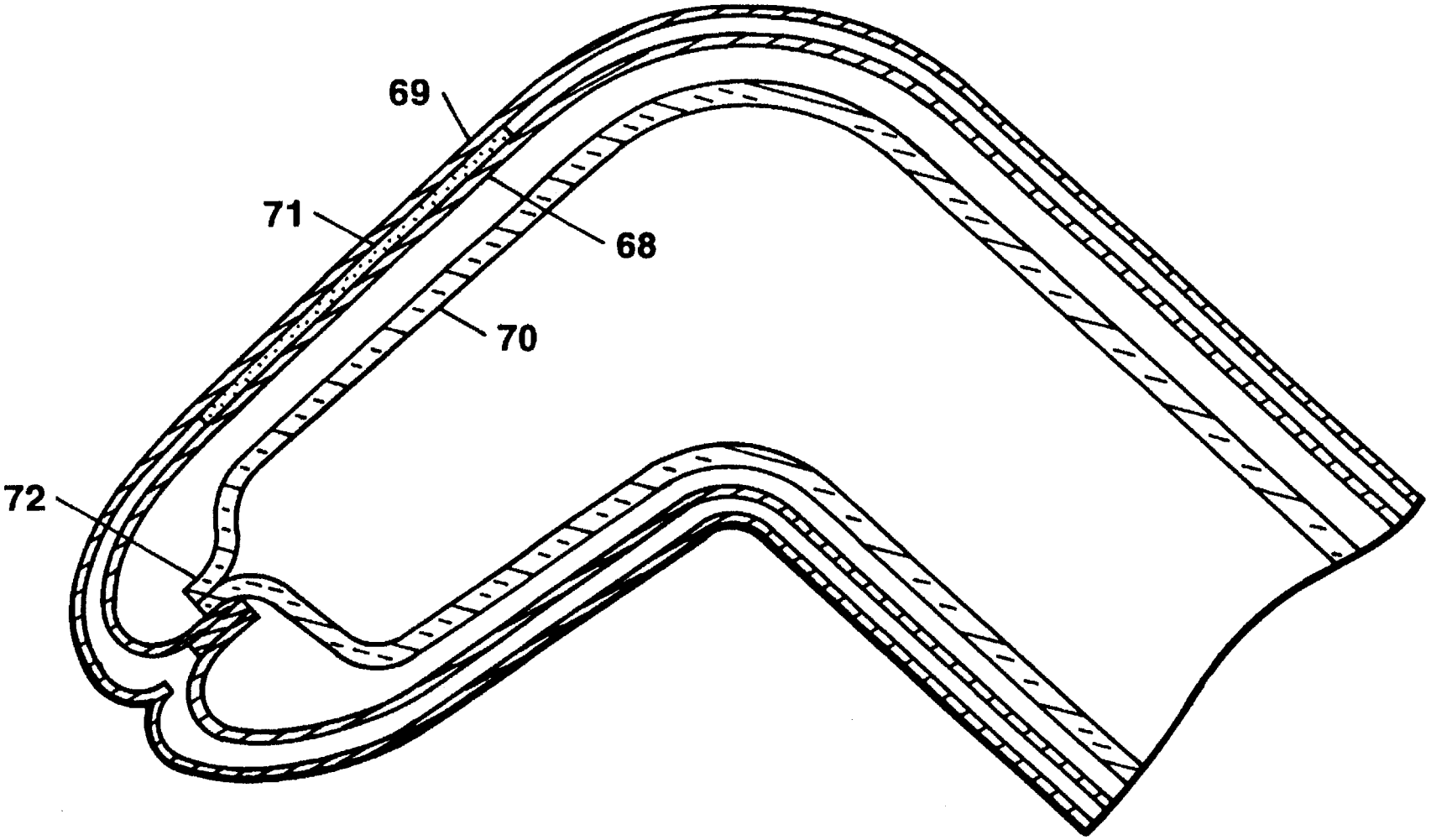
FIG. 10 is a cross-sectional view of the finger portion of a hand covering showing an outer glove shell attached to a liner layer and an insulation layer.

Referring now to FIG. 10, there is shown cross-sectional view of a finger portion of a glove assembly incorporating a three layer design. Each layer may be fabricated according to the present invention. Liner 68 is disposed between outer shell 69 and inner insulation layer 70. The separate layers in the glove construction may be attached to each other by conventional techniques. Liner 68 is connected to the outer shell 69 along the finger portions of the hand coveting. This may be done by bonding the two together with a cement or glue 71. This attachment prevents the liner from being pulled out of the glove when it is taken off of the wearer's hand. Where the glove includes an insulation layer 70, the liner 68 is attached to the insulation layer 70 by sewing as shown at 72 at the tip of each finger to prevent the insulation layer from being pulled apart from the assembly.

Figure 11:
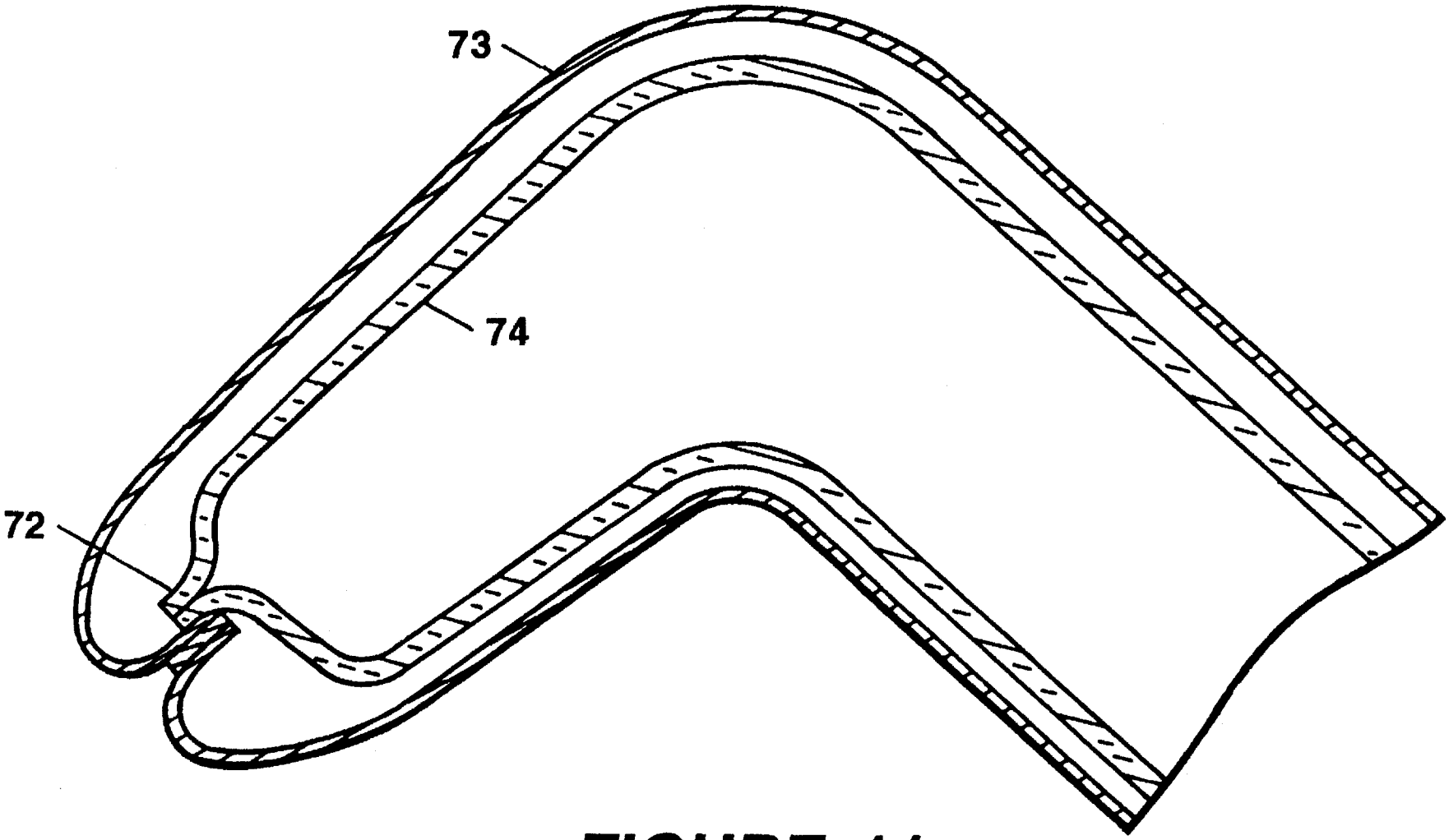
FIG. 11 is a cross-sectional view of the finger portion of a hand covering showing an outer glove shell attached to a liner layer.

Referring now to FIG. 11, there is shown a cross-sectional view of a finger portion of a glove assembly incorporating a two layer design including an outer glove shell 73 and a glove liner 74. In the preferred embodiment the outer glove shell 73 is attached to the glove liner 74 by sewing at the tip of each finger asshown at 72 while the outer glove shell 73 is turned inside out and the glove liner 74 is right side out. After sewing the outer glove shell 73 to the glove liner 74, the outer glove shell 73 is turned fight side out over the glove liner 74 to produce the finished glove.

Throughout this application the term sealing and seaming has and will be used interchangeably. Either term is intended to indicate the method used to secure pieces of material together. However, the terms sealing or seaming are intended to describe any means by which materials can be joined or secured, including, but not limited to: sealing, seaming by traditional sewing, welding, heat sealing, ultrasonic sealing, RF sealing, gluing or stapling. Also, throughout this application the term hand covering has and will be used to mean both a hand covering and/or a hand covering insert.

The foregoing drawings and detailed description are to be considered purely illustrative and not restrictive in nature, and any changes and modifications that come within the spirit of the invention are also desired to be protected.

What is claimed is:

1. A method of manufacturing a hand covering having a one piece lower hand portion and a finger portion comprising the steps of:

(a) folding said one piece lower hand portion having a first thumb extension on a first edge and a second thumb extension on a second edge over onto itself such that said first and second edges and said first and second thumb extensions are superimposed on each other;

(b) seaming said superimposed edges and superimposed thumb extensions together to form a tube-like structure having first and second open opposing edges located about a longitudinal axis and first and second sides located radially spaced from said longitudinal axis;

(c) rotating said tube-like structure about said longitudinal axis until said seamed edges are located between and spaced apart from said first and second sides; and (d) seaming said first open opposing edge to said finger portion such that said thumb extension is located in opposition to said finger portion.

2. A method of manufacturing a hand covering having a lower hand portion and a finger portion comprising the steps of:

(a) positioning a palm part having a palm part first edge with an integral thumb extension and a palm part second edge located opposite said palm part first edge on top of a back part having a back part first edge with an integral thumb extension and a back part second edge located opposite said back part first edge, such that said palm back first edge with an integral thumb extension and said back part first edge with an integral thumb extension are superimposed on each other;

(b) seaming together said palm part first edge with an integral thumb extension and said back part first edge with an integral thumb extension;

(c) seaming together said palm part second edge and said back pan second edge to form a tube-like structure having two open opposing edges located about a longitudinal axis and first and second sides located radially spaced from said longitudinal axis;

(c) rotating said tube-like structure about said longitudinal axis such that when said lower hand portion is laid flat, said seamed edges are located spaced apart from and between said first and second sides; and (d) seaming said tube-like structure to said finger portion such that said seamed first edges with integral thumb extensions are located in opposition to said finger portion.

* * * * *